United States Patent [19]

Irish

[11] 4,073,114

[45] Feb. 14, 1978

[54] INSERT ASSEMBLY FOR USE IN PRE-STRESSED CONCRETE STRUCTURES

[75] Inventor: Elwood Irish, Wayne, Mich.

[73] Assignee: Unistrut Corporation, Wayne, Mich.

[21] Appl. No.: 783,677

[22] Filed: Apr. 1, 1977

[51] Int. Cl.[2] ..... E04B 1/41

[52] U.S. Cl. ..... 52/710; 52/225; 52/684; 52/707

[58] Field of Search ..... 52/710, 704, 707, 703, 52/706, 698, 677, 699, 684, 711, 125, 225, 226, 719, 685

[56] References Cited

U.S. PATENT DOCUMENTS

| | | | |
|---|---|---|---|
| 1,241,827 | 10/1917 | Davis | 52/707 X |
| 1,244,034 | 10/1917 | Cummings | 52/706 |
| 1,260,748 | 3/1918 | Brooks | 52/684 X |
| 1,324,517 | 12/1919 | Pauly | 52/684 X |
| 1,470,727 | 10/1923 | Hall | 52/699 X |
| 1,695,909 | 12/1928 | Baner | 52/710 X |
| 2,843,230 | 7/1958 | Nelsson | 52/719 |
| 3,086,329 | 4/1963 | Schneller | 52/710 X |
| 3,095,672 | 7/1963 | Tullio et al. | 52/710 |
| 3,289,379 | 12/1966 | Watts | 52/699 X |
| 3,813,834 | 6/1974 | Davis, Jr. | 52/699 X |

FOREIGN PATENT DOCUMENTS

| | | | |
|---|---|---|---|
| 2,503,722 | 8/1976 | Germany | 52/710 |
| 369,274 | 6/1963 | Switzerland | 52/707 |

*Primary Examiner*—Leslie Braun

*Attorney, Agent, or Firm*—Peter Xiarhos; David M. Keay; Norman J. O'Malley

[57] ABSTRACT

An insert assembly adapted to be imbedded within a concrete beam structure with portions exposed at a surface of the beam structure so as to allow equipment such as piping, conduit, cable supports and the like to be attached to the insert assembly and, thus, supported by the beam structure. The insert assembly includes a generally U-shaped channel section to which the aforementioned equipment may be secured, a plurality of pairs of anchor members attached to and extending upwardly from the channel section, and a plurality of spring members attached to and between the pairs of anchor members. In the construction of a concrete beam structure, the insert assembly is placed within and against the formwork for the concrete beam structure and an elongated reinforcing member such as a cable or rod is placed across the spring members. The reinforcing member is then placed under tension, causing the spring members to deflect downwardly whereby forces are directed downwardly toward the channel section and the formwork. These forces serve to firmly retain the insert assembly in position within and against the formwork. After the reinforcing member has been placed in tension, concrete mix is poured into the formwork. After the mix has hardened, the formwork is removed so as to produce the finished pre-stressed concrete beam structure having the insert assembly imbedded therein.

4 Claims, 5 Drawing Figures

INSERT ASSEMBLY FOR USE IN PRE-STRESSED CONCRETE STRUCTURES

BACKGROUND OF THE INVENTION

The present invention relates to an insert assembly and, more particularly, to an insert assembly for use in pre-stressed concrete structures, for example, pre-stressed concrete beams.

In the construction of certain buildings employing pre-stressed concrete beams, it has been found desirable to provide channel sections in the beams so that equipment such as piping, conduit, cable supports, shelving and the like may be secured or connected with the channel sections. One very well known type of channel section which may be used in the above fashion is sold commercially by Unistrut Corporation, Wayne, Mich., under the trade name "Unistrut" and includes a plurality of walls or sides arranged with respect to each other in a generally "U" configuration with edges of two of the walls opposing each other being inwardly turned to form flanges. These flanges define a longitudinal channel in the section with which connecting elements such as nuts, fittings, clamps and the like may be used for securing or connecting members with the channel section. A channel section such as described hereinabove is shown and described, by way of example, in U.S. Pat. Nos. 2,696,139 and 3,417,951, both of which are assigned to the same assignee as the present application.

In one method of construction of a concrete beam having a channel section therein as discussed hereinabove, the channel section is first placed within the formwork for the concrete beam and, after an elongated reinforcing member has been positioned adjacent to the channel section and placed under tension, a concrete mix is poured into the formwork and allowed to harden, following which the formwork is removed to produce the pre-stressed beam. A problem which has been observed in the abovedescribed operation is that it is difficult to firmly hold the channel section in place during the concrete pouring phase, especially since the concrete mix is generally agitated to eliminate the presence of air bubbles which could degrade the quality of the finished beam. Further, since the formwork is usually made of metal or some other permanent type of material, for rendering the formwork reusable, it is not desirable to bolt, nail or otherwise physically secure the channel section to the formwork.

The present invention is directed to an insert assembly which overcomes the problems as described hereinabove.

BRIEF SUMMARY OF THE INVENTION

In accordance with the present invention, an insert assembly is provided which avoids the problems associated with previous methods for constructing beam structures having channel sections formed therein. The insert assembly in accordance with the invention generally includes an elongated channel section to which structural members may be physically attached, a plurality of pairs of anchor members, and a plurality of spring members. The elongated channel section is adapted to be positioned within and against formwork for a concrete structure in which the insert assembly is to be imbedded. The plurality of pairs of anchor members are secured to and extend away from the channel section, and the plurality of spring members are attached to the pairs of anchor members with each of the spring members being suspended between the anchor members of a different pair of anchor members in a direction toward the channel section.

The plurality of spring members as described above are operative in accordance with the invention to receive an elongated reinforcing member, such as a reinforcing rod or cable, and to be deflected by the reinforcing member in a direction toward the channel section. As a result of the deflection of the spring members, forces are established in the direction of the channel section and act to maintain the insert assembly in place within and against the formwork for the concrete structure.

BRIEF DESCRIPTION OF THE DRAWING

Various objects, features and advantages of an insert assembly in accordance with the present invention will be apparent from the following detailed description taken in conjunction with the accompanying drawing in which.

DETAILED DESCRIPTION OF THE INVENTION

Figure 1:
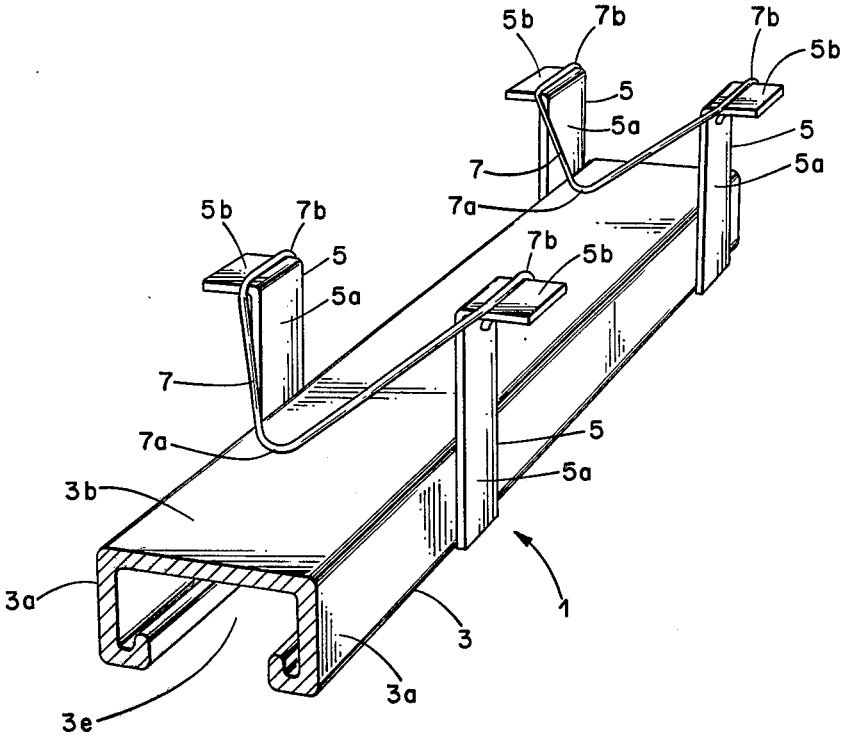
FIGS. 1, 2, 3 and 4 are perspective, front, side and top views, respectively, of an insert assembly in accordance with the present invention.

Referring now to FIGS. 1–4, there is shown an insert assembly 1 in accordance with the present invention. The insert assembly 1 is intended to be imbedded within a concrete beam structure, such as shown in a sectional view in FIG. 5, so that equipment such as piping, conduit, cable supports, shelving and the like may be secured or otherwise connected with the insert assembly 1 and, thus, to the concrete beam structure.

As shown in FIGS. 1–4, the insert assembly 1 generally includes a generally U-shaped elongated channel section 3, a plurality of anchor members 5 secured to and extending upwardly from the channel section 3, and a plurality of spring members 7 attached to and between pairs of the anchor members 5. For the sake of simplicity, only two pairs of anchor members 5 and two spring members 7 are shown in the drawing. The generally U-shaped channel section 3 may be of a type such as manufactured and sold by Unistrut Corporation, Wayne, Mich., under the trade name "Unistrut" and has first and second vertical side walls **3*a* bridged by a third horizontal back wall 3*b*. The edges of the side walls 3*a* are further turned up in the direction of the wall 3*b* to form flanges 3*d* defining a longitudinal opening 3*e* (FIG. 2) by which equipment such as piping, conduit, cable supports, shelving and the like may be secured or connected to the channel section 3, using the appropriate fittings, clamps, etc. If desired, a cardboard insert 8 such as shown in dotted outline in FIG. 2 may be inserted within the channel section 3 via the opening 3*e* so as to prevent concrete mix from entering into the volume defined by the walls 3*a* and 3*b* of the section 3 during the construction of a concrete beam structure, as will be discussed in detail hereinafter. The channel section 3** as described hereinabove is preferably constructed of cold formed steel.

The aforementioned anchor members 5, typically of steel, are generally L-shaped members with vertical rectangular portions 5*a* in planes generally normal to the plane of the back wall 3*b* of the channel section 3 and outwardly directed horizontal rectangular portions 5*b* generally normal to the portions 5*a*. The anchor members 5 are arranged in pairs with each member of the pair being secured, as by welding, to a corresponding one of the side walls 3*a* of the channel section 3. Alternatively, each of the pairs of anchor members 5 may be configured so that they can be secured to the back wall 3*b* of the channel section 3 or still further, formed as a single piece and secured to the back wall 3*b* of the channel section 3.

Figure 6:
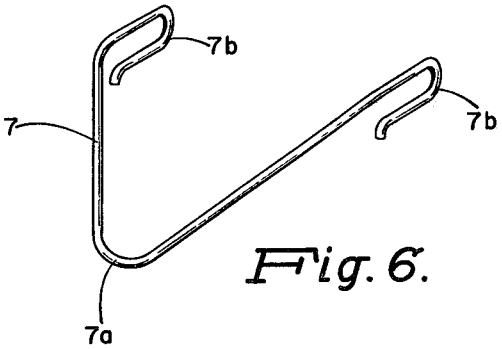
FIG. 6 is a perspective view of a spring member employed by the insert assembly of the invention.

The aforementioned spring members 7 are of a configuration as shown in detail in FIG. 6 and include a generally V-shaped central portion 7*a* and a pair of generally U-shaped end portions 7*b* integral with the central portion 7*a*. As indicated in FIGS. 1–4, the end portions 7*b* of the spring members 7 are arranged to clip onto or grasp the horizontal portions 5*b* of the anchor members 5 for the purpose of attaching the spring members 7 to and between the pairs of anchor members 5. The central portions 7*a* of the spring members 7 are arranged to be directed downwardly in a direction toward the back wall 3*b* of the channel section 3, for example, at an angle A of approximately 35° with respect to the planes of the horizontal portions 5*b* of the anchor members 5 and at an angle B of approximately 55° with respect to edges of the vertical portions 5*a* of the anchor members 5. The spring members 7 are typically constructed from a spring wire material (e.g., 14 gauge wire) or of plastic.

Figure 5:
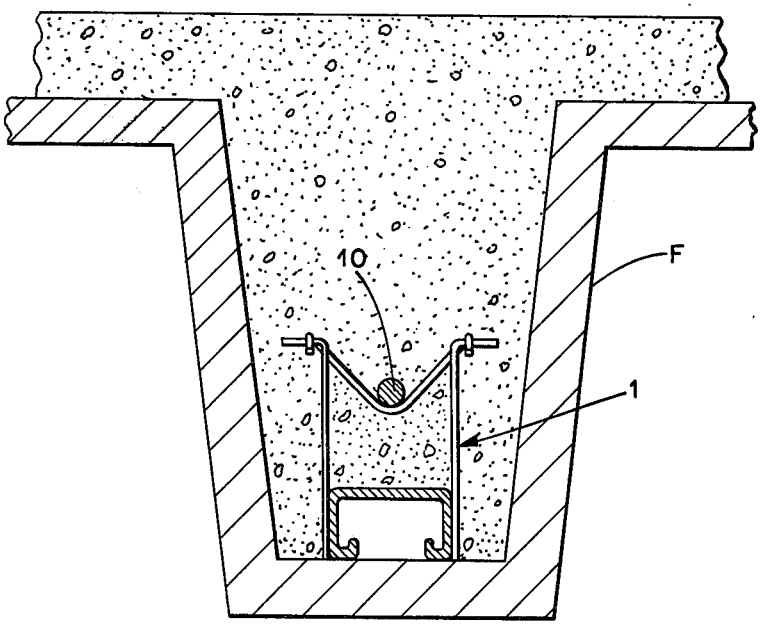
FIG. 5 is a sectional view illustrating a concrete beam structure and associated formwork and the manner in which the insert assembly of FIGS. 1–4 is imbedded within the concrete beam structure in accordance with the invention.
Figure 3:
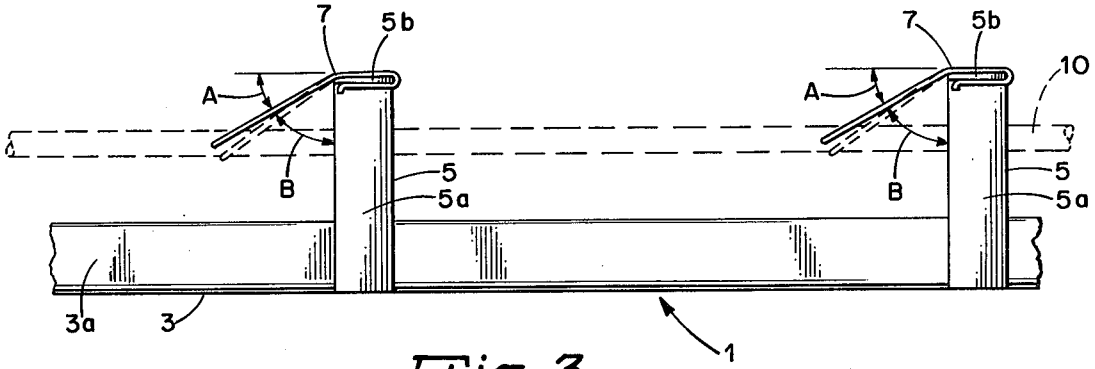
Figure 4:
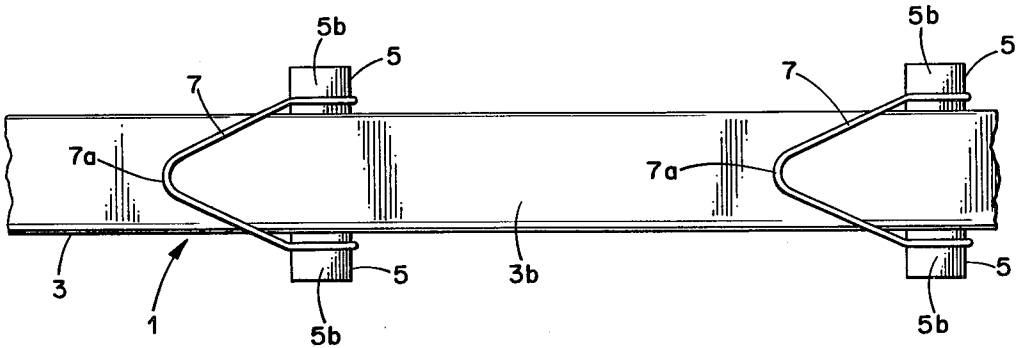
Figure 2:
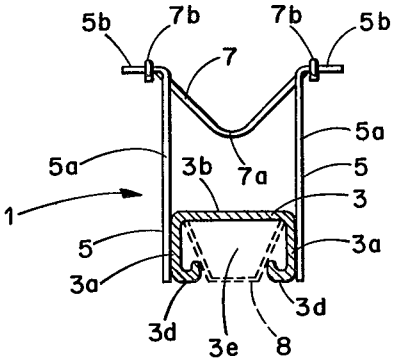

To imbed the insert assembly 1 as described hereinabove within a concrete beam structure as shown in FIG. 5, the insert assembly 1 is first placed within and against a formwork F for the concrete beam structure, as generally indicated in FIG. 5. An elongated reinforcing member 10 as shown in dotted outline in FIG. 3 is then placed across the spring members 7 so that it lies within the generally V-shaped portions 7*a* of the spring members 7. The reinforcing member 10, which may be a solid metal rod or a multiple-strand metal cable, is then placed in tension, in a known fashion not described herein, causing the spring members 7 to be deflected downwardly as indicated, for example, in FIG. 3. As a result of the deflection of the spring members 7, forces are directed downwardly toward the channel section 3 and the formwork. These downward forces serve to retain the insert assembly 1 in position within and against the formwork, without the requirement that the insert assembly 1 be physically attached to the formwork. After the reinforcing member 10 has been stressed as mentioned above, a concrete mix is poured into the formwork in and around the insert assembly 1 and the reinforcing member 10. If desired, the concrete mix may be agitated to remove air bubbles without disturbing the position of the insert assembly 1. After the concrete mix has hardened, the formwork F is removed so as to produce the finished pre-stressed concrete beam structure having the insert assembly 1 embedded therein as shown in FIG. 5.

While there has been described what is considered to be a preferred embodiment of the invention, it will be obvious to those skilled in the art that various changes and modifications may be made therein without departing from the invention as called for in the appended claims.

What is claimed is:

1. An insert assembly adapted to be imbedded within a concrete structure, comprising:

an elongated channel section to which structural members may be physically attached, said channel section being adapted to be positioned within and against formwork for a concrete structure and including first and second side walls bridged by a back wall, said side walls having edges turned in the direction of the back wall to form flanges defining a longitudinal opening by which structural members may be physically attached to the channel section;

a plurality of pairs of rigid anchor members fixedly secured to and extending away from the channel section, each of the anchor members including a first portion attached to and extending away from the channel section at the back wall of the channel section and a second portion at an angle to the first portion; and a plurality of spring members attached to the pairs of anchor members with each of the spring members being suspended between the anchor members of a different pair of anchor members in a direction toward the channel section, each of the spring members including first and second end portions attached to the second portions of a different pair of anchor members and a central portion integral with and intermediate to the end portions and at an acute angle with respect to the plane of the back wall of the channel section, said central portion being intermediate to and extending from the second portions of the anchor members in the direction of the back wall of the channel section, said plurality of spring members being operative to receive an elongated reinforcing member at the central portions thereof and to be deflected by said reinforcing member in a direction toward the back wall of the channel section, whereby when the spring members are deflected forces are established in the direction of the channel section for maintaining the insert assembly in place within and against the formwork for the concrete structure.

2. An insert assembly in accordance with claim 1 wherein:

the spring members are formed of a wire material.

3. An insert assembly in accordance with claim 1 wherein:

the first and second portions of the anchor members are flat, rectangular portions; and the first and second end portions of the spring members are generally U-shaped portions and the central portions of the spring members are generally V-shaped portions.

4. An insert assembly in accordance with claim 3 wherein:

the first portions of the anchor members extend away from the channel section in planes generally normal to the plane of the rear wall of the channel section, and the second portions of the anchor members extend outwardly in opposite directions from the first portions in planes generally normal to the planes of the first portions.

* * * * *